US006724154B2

(12) United States Patent
Iannini

(10) Patent No.: US 6,724,154 B2
(45) Date of Patent: Apr. 20, 2004

(54) COLD CATHODE LAMP AND LAMP CONTROL CIRCUIT

(76) Inventor: Robert E. Iannini, Brook Rd., Mont Vernon, NH (US) 03057

( * ) Notice: Subject to any disclaimer, the term of this patent is extended or adjusted under 35 U.S.C. 154(b) by 0 days.

(21) Appl. No.: 10/293,381

(22) Filed: Nov. 12, 2002

(65) Prior Publication Data

US 2003/0090218 A1 May 15, 2003

Related U.S. Application Data

(60) Provisional application No. 60/350,649, filed on Nov. 13, 2001.

(51) Int. Cl.[7] ..... H05B 37/00

(52) U.S. Cl. ..... 315/219; 315/224; 315/DIG. 7

(58) Field of Search ..... 315/224, 247, 315/246, DIG. 7, 219

(56) References Cited

U.S. PATENT DOCUMENTS 6,130,509 A * 10/2000 Kates et al. ..... 315/224
6,316,883 B1 * 11/2001 Cho et al. ..... 315/247

* cited by examiner

*Primary Examiner*—David Vu
(74) *Attorney, Agent, or Firm*—Davis & Bujold, PLLC

(57) ABSTRACT

A cold cathode gas discharge lamp unit and control circuit for controlling the light emission of the cold cathode gas discharge lamp. A lamp unit includes a dc power source and a control circuit for converting into a high frequency drive signal across the lamp wherein each cycle of the drive signal includes an ignition period with a signal level sufficient to initiate gas conduction, a sustaining period with a signal level sufficient to sustain gas conduction, and an off period with a signal level below the sustaining level.

13 Claims, 3 Drawing Sheets

COLD CATHODE LAMP AND LAMP CONTROL CIRCUIT

This application claims the benefit of Provisional application Ser. No. 60/350,649 filed Nov. 13, 2001.

FIELD OF THE INVENTION

The present invention relates to a high efficiency light source and, in particular, to a high efficiency cold cathode gas discharge lamp control and power circuit.

BACKGROUND OF THE INVENTION

A recurring problem in lighting technology is that of maximizing the efficiency and minimizing the power consumption of a light sources while meeting user needs and desires, such as simplicity, ease and low cost in fabricating and installing the light sources and, for example, in controlling the level of light output of a light source. Other factors may include, for example, the ability to place the light source where desired, to direct the light output where desired, the ability to control or determine the color of the light, and achieving an esthetic appearance of the light and light source under a range of conditions, such as when the light is dimmed as well as at full brightness.

The two most common light sources are incandescent lights and fluorescent lights. As is well known, incandescent lamps generate light by resistance heating of a filament in a vacuum or inert gas environment to such a temperature that the filament emits visible light. Incandescent lamps generally meet many of the above requirements and needs, except for inherently high power consumption and low power efficiency. Cold cathode gas discharge lamps offer much higher operating efficiencies, but generally fail to meet others of the needs and requirements outlined above.

Cold cathode gas discharge lamps, also referred to as cold cathode gas discharge tube or, because of their generally tubular shape, or as flourescent lights or tubes, emit light by the spontaneous decay of energized gas atoms excited by an externally supplied electrical discharge. As described above, the advantages of cold cathode gas discharge lamps are high output efficiency for a given power input and reduced heat generation. Gas discharge lamps also generally generate a homogenous light output over a continuous surface, thereby providing a generally more comfortable and pleasing lighting effect. In addition, different colors or emission spectrums may be readily achieved by the use of different phosphors, so that cold cathode discharge lamps, most of which generate a "cool" spectrum light, can also be designed to emit, for example, a warmer light spectrum emulating daylight or light optimized for growing plants.

The disadvantages of cold cathode gas discharge lamps of the prior art, however, include the requirement for expensive, bulky and inefficient power conditioning because of the operating characteristics of the lamps. That is, cold cathode gas discharge lamps require a high initial triggering potential across or through the tube to initially excite the gas atoms into the light emitting state. Once triggered into the light emitting state, however, the gas plasma demonstrates a negative resistance characteristic wherein the resistance of the gas decreases as the discharge current through the gas increases. The negative resistance characteristic may thereby result in a runaway condition that may destroy the lamp unless the current discharge through the tube is limited. The current through the gas, after the initially triggering, must be sufficient to sustain ignition and emission of the light by the gas. A cold cathode gas discharge lamp therefore requires additional control circuits that provide both a high initial triggering potential across the tube to initiate light emission by the gas and a large current controlling impedance, referred to as a "ballast", to limit the current through the gas to the sustaining current level after emission is initiated. The control circuits for cold cathode gas discharge lamps are expensive, cumbersome and heavy, particularly at the conventional line frequency of 60 Hz. These problems are further compounded in that the cold cathode gas discharge lamp control circuits of the prior art typically use inductive components in the current limiting ballast circuits, which may result in a high apparent power consumption due to uncorrected power factors, particularly at 60 Hz. These disadvantages of the prior art in cold cathode gas discharge lamps and lamp control circuits have as a result largely offset the above discussed advantages of cold cathode gas discharge lamps.

SUMMARY OF THE INVENTION

The present invention is directed to a cold cathode gas discharge lamp unit includes a control circuit for controlling the light emission of the cold cathode gas discharge lamp. According to the present unit, a lamp unit includes a dc power source and a control circuit for converting dc power from the dc power source into a high frequency drive signal across the lamp wherein each cycle of the drive signal includes an ignition period with a signal level sufficient to initiate gas conduction, a sustaining period with a signal level sufficient to sustain gas conduction, and an off period with a signal level below the sustaining level.

The control circuit of the present invention includes a transformer having a primary winding connected from a dc power source and in series with a switching transistor and a secondary winding connected across the lamp and a drive signal timing circuit wherein the drive signal timing circuit includes circuit timing a feedback winding of the transformer connected between the base of the switching transistor and a timing control output of a resistor-capacitor ramp generator.

In each cycle of the drive signal, and during the off period, the drive signal timing circuit generates a timing control output having a voltage level increasing with time until the timing control output reaches a base-emitter turn on voltage of the transistor. During the ignition period current flows through the transistor and in the primary winding, the current flow being initiated by the timing control output and sustained by feedback from the primary winding to the feedback winding, until the transformer saturates and the feedback signal to transistor is terminated, driving the transistor into the non-conducting state, and a magnetic field in the transformer collapses, inducing a drive signal in the secondary winding having a signal level sufficient to initiate gas conduction in the lamp. During the sustaining period continued collapse of the magnetic field induces a drive signal in the secondary winding having a signal level sufficient to sustain gas conduction, and, during the off period, the magnetic field has collapsed and the induced drive signal in the secondary winding is at a signal level below the sustaining level.

In various embodiments of the lamp unit, the dc power source may an ac to dc adaptor connected from an ac power source and the resistor-capacitor ramp generator of the drive signal timing circuit may include a variable resistor to select the period of the drive signal and thereby to control the level of light emission.

In other embodiment, the lamp units may be incorporated into a lighting system wherein the dc power source of at least one of the lighting units may be a central dc power source, or, in an alternative embodiment of the system, an dc adapter may be located at each of one or more of the lighting units to provide dc power to those lighting units and the dc adapter may be connected from an ac power source.

In other embodiments, a lamp unit may include a tubular lamp housing with a U-shaped cold cathode gas discharge lamp mounted in the housing with all electrodes of the lamp located at a base end of the housing. The control circuit may then be mounted in the base end of the housing to convert dc power from a dc power source into the high frequency drive signal across the lamp. The lamp unit may also include a mounting bracket for attaching the light unit to a support, an dc adapter located at the lighting unit and connected from an ac power source to provide dc power to the lighting unit, and at least one canopy mounted to the tubular housing to direct the emitted light.

BRIEF DESCRIPTION OF THE DRAWINGS

The foregoing and other objects, features and advantages of the present invention will be apparent from the following description of the invention and embodiments thereof, as illustrated in the accompanying figures, wherein.

DETAILED DESCRIPTION OF THE INVENTION

A. Control Circuit Description

Figure 1A:
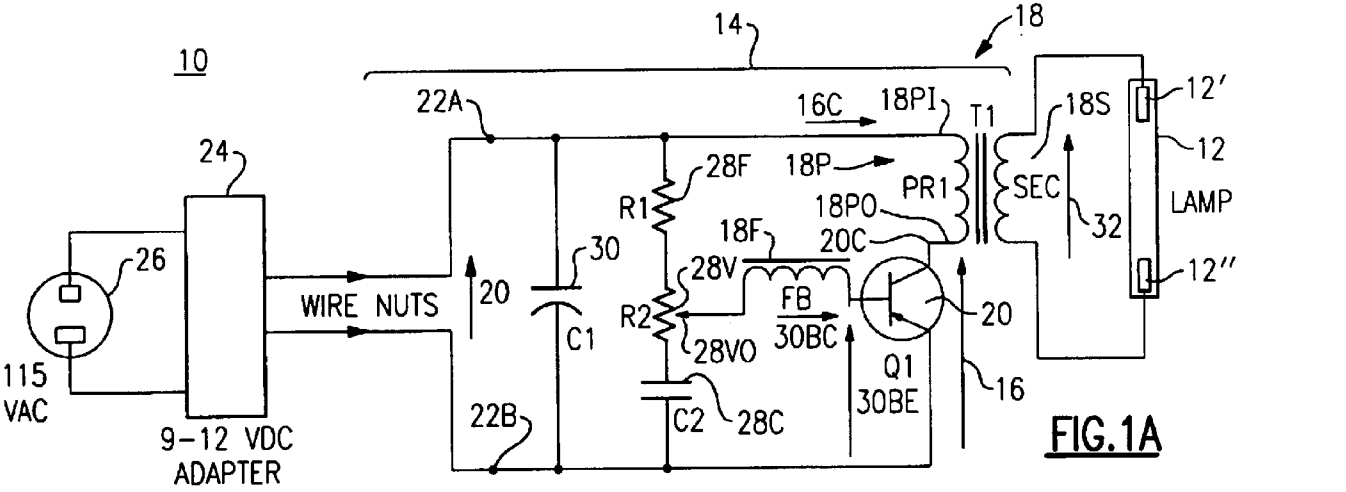
FIGS. 1A, 1B and 1C are respectively a block diagram of a control circuit and lamp unit, a timing diagram of a drive signal generated by the control circuit and a timing diagram of current flow through a control transistor.
Figure 1C:
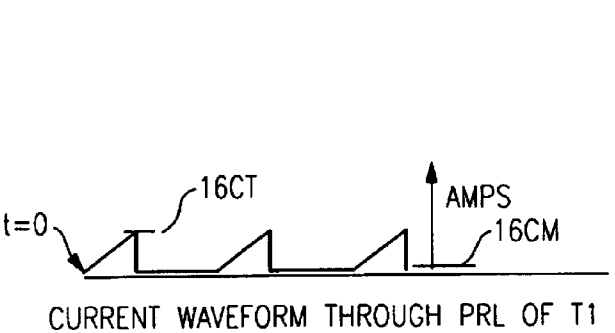
Figure 1B:
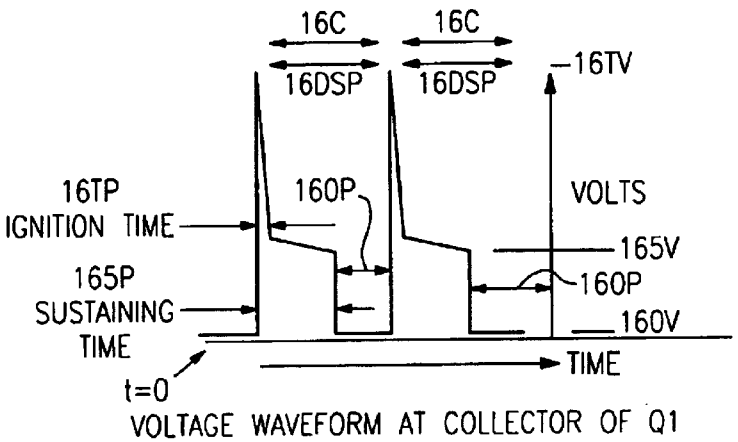

Referring to FIGS. 1A, 1B and 1C, there is shown a block diagram of a Cold Cathode Lighting Unit 10 including a Cold Cathode Gas Discharge Lamp (Lamp) 12 and a Control Circuit 14 of the present invention. As described below, and according to the present invention, Control Circuit 14 controls the emission of Lamp 12 by driving Lamp 12 with a high frequency, switched waveform, identified as Drive Signal 16, which drives Lamp 12 through a saturable Transformer 18. The waveform voltage of Drive Signal 16 as it appears at the Collector 20C of a Switching Transistor (Transistor) 20 is illustrated in FIG. 1B while the waveform of the resulting Drive Current 16C through the Primary Winding 18P is illustrated in FIG. 1C.

According to the present invention, Drive Signal 16 drives Lamp 12 on and off during each Cycle 16C of a Drive Signal 16, which controls the voltage and current levels driving Lamp 12. In each Cycle 16C, Drive Signal 16 includes (1) an initial Trigger Period 16TP wherein Drive Signal 16 has Trigger Voltage 16TV level sufficient to initiate current flow in and emission by Lamp 12, (2) a Sustaining Period 16SP wherein Drive Signal 16 is at a Sustaining Voltage 16SV level sufficient to maintain a sustaining current through Lamp 12, and (3) an Off Period 16OP wherein Drive Signal 16 is at an Off Voltage 16OV at which Lamp 12 emission and current flow are not sustained and Lamp 12 does not emit. As illustrated in FIG. 1C, Drive Current 16C through Primary 18P of Transformer 18 maintains the same cyclic period as Drive Signal 16. As illustrated, during Off Period 16OP Drive Current 16C increases from a minimum level, indicated as the Drive Current 16CM level, to a trigger level, indicated as the Drive Current 16CT level, at the end of Off Period 16OP and the start of Trigger Period 16TP, at the conclusion of which the Drive Current 16C drops to the Drive Current 16CM level.

In a typical and exemplary embodiment of the present invention, the Period 16DSP of Drive Signal 16 is in the range of 40 to 50 microseconds, so that the Drive Signal 16 frequency is in the range of 20 to 25 khz, Trigger Period 16TP is in the range of about 1 to 2 microseconds. Sustaining Period 16SP is the range 20 to 30 microseconds and Off Period 16OP is in the range 20 to 30 microseconds, while Trigger Voltage 16TV is in the range of about 1 to 2 kv, Sustaining Voltage 16SV is in the range 200 to 400 volts, Off Voltage 16OV is in the range 0.2 to 0.5 volts and Drive Current 16CM and Drive Current 16CT are the ranges zero to about 1 amp. In such an exemplary embodiment, the components comprising Control Unit 14 may, for example, include Filter Capacitor 30 (which can be 10–100 mfd), Fixed Resistor 28F (470 to 1 kohm), Variable Resistor 28V (5 to 10 k), Timing Capacitor 28C (0.01 to 0.1 mfd), Transformer 18 (a saturable core with a 350 turn secondary winding, a 10 turn primary winding and 5 turn feedback winding), Control Transistor 20 (is an NPN power semiconductor) and, again for example, a Lamp 12 (gas discharge filled with argon and mercury and coated with color phosphors) and a DC Adaptor 24 (9–12 volts DC at 0.3 to 0.5 amps).

In the embodiment of Control Circuit 14 illustrated in FIG. 1A, Input Terminals 22A and 22B of Power Input 22 are connected from a DC Adaptor 24 that provides DC power in the range of 9 to 12 volts, for example, and is connected from, for example, an AC Power Source 26 such as a 115 VAC, 60 Hz power line. It will be recognized, however, that Power Input 22 may be connected from any of a variety of dc power sources, such as a battery or solar cell power sources, and that if an AC Power Source 26 is employed, the ac source voltage may be any of a wide range of voltage levels and frequencies, such as conventional European power lines.

As illustrated, Terminal 22A of DC Power Input 22 is connected to an Input Terminal 18PI of Primary Winding 18P of Transformer 18 and an Output Terminal 18PO of Primary Winding 18P is connected to Collector 20C of Control Transistor 20 while the Emitter 20E of Control Transistor 20 is connected to Terminal 22B of DC Power Input 22.

A Fixed Resistor 28F, a Variable Resistor, or potentiometer, 28V and a Timing Capacitor 28C are connected in series between Terminals 22A and 22B, in that order, and in parallel with a Filter Capacitor 30 that is connected between Terminals 22A and 22B. As shown, a Variable Control Output 28VO of Variable Resistor 28V is connected through a Feedback Winding 18F of Transformer 18 to the Base 20B of Control Transistor 20, and Secondary Winding 18S of Transformer 18 is connected to the terminals 12' and 12" of Lamp 12.

Operation of Control Circuit 14 begins when DC power is provided to Input Terminals 22A and 22B of Power Input 22 from, for example, a DC Adaptor 24 or any other suitable source of DC power. At the start of a Cycle 16C, which may be the first Cycle 16C at power on, Timing Capacitor 28C charges through Resistors 28F and 28V and Variable Control Output 28VO of Variable Resistor 28V is provided to Base 20B of Transistor 20 as a Transistor 20 Base-Emitter Voltage 30BE. When Base-Emitter Voltage 30BE reaches the base-emitter turn on voltage for Transistor 20, Transistor 20 begins to conduct and Drive Current 16C flows through Primary Winding 18P of saturable Transformer 18. The flow of Drive Current 16C through Primary Winding 18P in turn induces a Base Hold-On Current 30BC through Feedback Winding 18F to maintain Transistor 20 in the conducting state, with the Base Hold-On Current 30BC also discharging Timing Capacitor 28C.

As described and as illustrated in FIG. 1C, Drive Current 16C will increase until Transformer 18 saturates, whereupon Base Hold-On Current 30BC induced in Feedback Winding 18F will cease and Transistor 20 will switch to the non-conducting, or off, state, thereby cutting off the flow of Drive Current 16C through the Primary Winding 18P of Transformer 18. The magnetic field in the core of Transformer 18 will rapidly collapse and the discharge of the magnetic energy stored in the core of Transformer 18 will induce a Trigger Voltage 16TV spike in Lamp Output 32 across Secondary Winding 18S of Transformer 18 during Trigger Period 16TP, which initiates, or triggers, the flow of current through Lamp 12 and the emission of light by Lamp 12.

Lamp Output 32 across Secondary Winding 18S will then decrease to the Sustaining Voltage 16SV level of Lamp 12 during Sustaining Period 16SP, thereby energizing Lamp 12 for the duration of Sustaining Period 16SP. In this regard, it will be noted that the Lamp Output 32 voltage level will be sustained longer than the triggering voltage level, that is, Sustaining Period 16SP will be longer than Trigger Period 16TP, because Lamp 12, when conducting, provides a resistance to the current induced in Secondary Winding 18S by Drive Current 16C, thereby lengthening the inductance/resistance (L/R) time constant of the circuit for a cycle.

At the end of Sustaining Period 16SP, completion of the collapse of the magnetic field in the core of Transformer 18 and the discharge of the magnetic energy stored therein will result in Drive Current 16C decreasing to a level lower than required to maintain Sustaining Voltage 16SV and Lamp Output 32 will drop to the Drive Current 16CM level during Off Period 160P. During Off Period 160P, Timing Capacitor 28C is recharging and the next Cycle 16C will begin when Base-Emitter Voltage 30BE reaches the base-emitter turn on voltage for Transistor 20, and so on for successive Cycles 16C.

Lastly, the time required for Variable Control Output 28VO and thereby Base-Emitter Voltage 30BE to reach the base-emitter turn-on level may be controlled by Variable Resistor 28V, which controls the charging time of Timing Capacitor 28C and thereby the length of Cycles 16. A lower value for the period of Cycles 16C will result in a higher rate of one cycles for Lamp 12 and thereby will increase the apparent brightness of Lamp 12 while a decrease in the rate of Cycles 16C will result in a decrease in the apparent brightness of Lamp 12. Also, it will be appreciated that at a sufficiently high pulse rate, the "flicker" rate of Lamp 12 will provide the appearance of continuous illumination but of higher or lower levels of light emission, allowing faster turn on of Q1 consequently more pulses into the lamp making it brighter. It will also be noted that the decay period for the emission of light by the filament of an incandescent lamp in Lamp 12 will decay slower than is typical for gas lamps, thereby additionally smoothing any apparent light emission from Lamp 12.

As discussed, therefore, conventional cold cathode discharge lamps are very efficient in terms light output compared to the actual power consumed, but have suffered because of the ballasting techniques employed, where normal 60 Hz household current has to be processed and controlled for compensation of the negative resistance effects of the gas discharge. The Control Circuit 14 described herein above overcomes these disadvantages by utilizing a high frequency self oscillating circuit driving a ferrite transformer with a closely coupled primary, secondary and feedback windings to switch power to the cold cathode gas discharge lamp, thereby reducing the bulk and expense of the control/ballast circuit and the apparent power consumption due to uncorrected power factors.

Exemplary Applications

Exemplary uses of a Lamp System 10 may range form outside accent lighting to inside mood lighting, to portable camping and emergency lights, to colored special effects and even as a viable replacement of normal lighting in many cases. The high illuminating output and relatively low input power requirements of a Lamp System 10 also allow effective and practical use of solar power and permit practical battery operation. The advantages of the present invention include not only high efficiency but high reliability as there are few components to degrade and fail, unlike the case of conventional fluorescent and incandescent lamps, which results in an increased lifetime. In addition, the power requirements for a Lighting Unit 10 are relatively minimal, 9 10 12 VDC that can be provided by a low cost wall adapter or by typical transformer used for existing garden accent lamps, which will typically power up to 15 Lamps 12. It will also be noted that the low supply voltage requirements allow "do it yourself" installations, such as around pools and other areas where 115 volt ac circuitry would be expensive and hazardous.

Figure 2A:
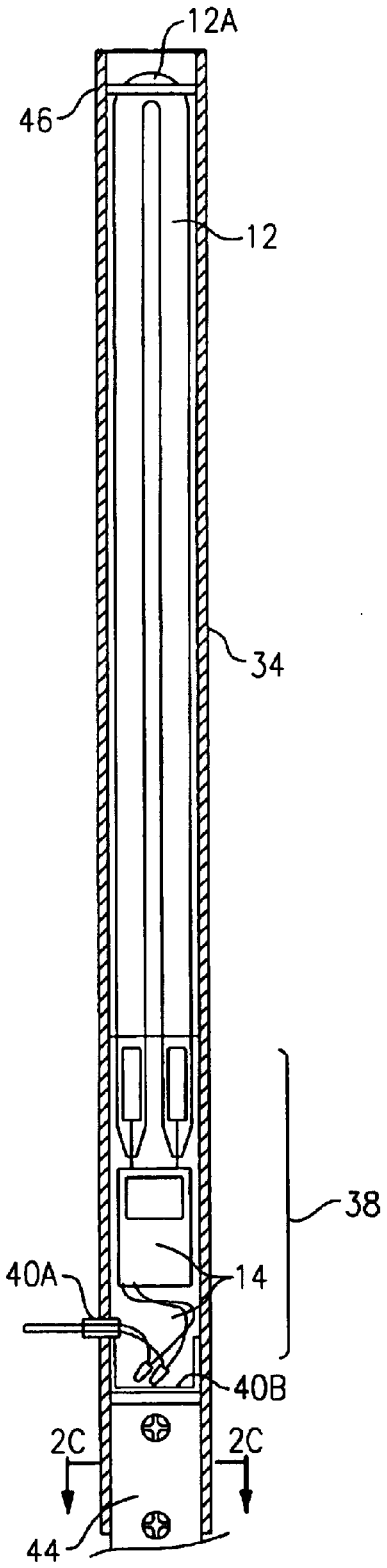
FIGS. 2A and 2B are illustrative diagrams of an implementation of a lamp unit.
Figure 2B:
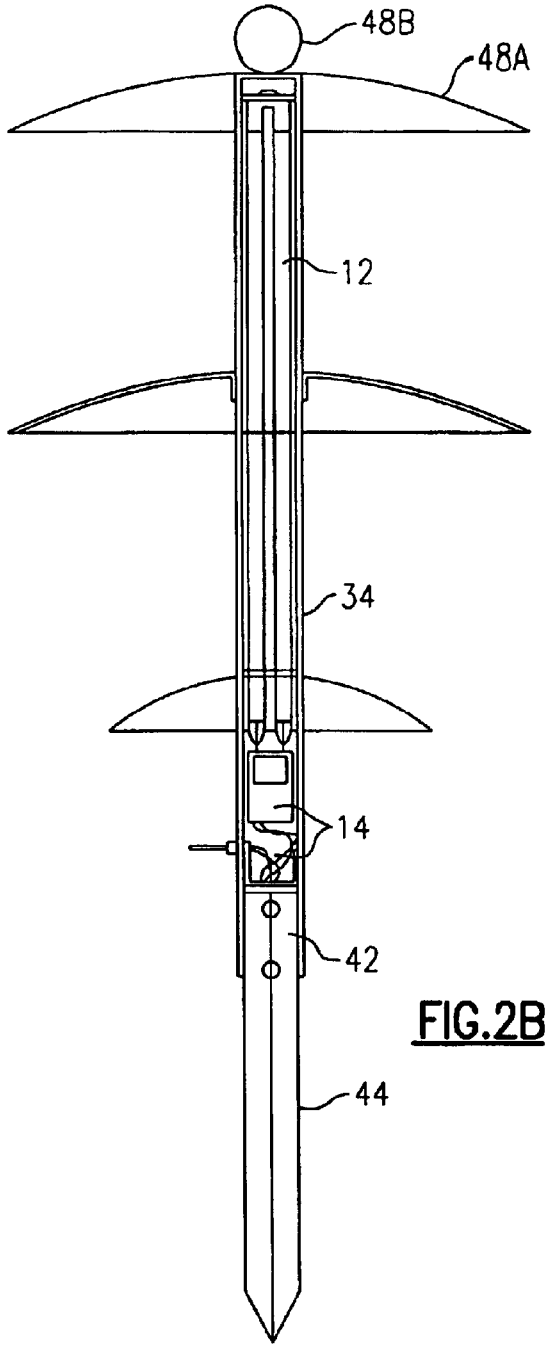
Figure 2C:
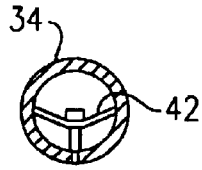
FIG. 2C is a cross section along line 2C—2C of FIG. 2A.

An exemplary embodiment of a Lighting Unit 10 is illustrated in FIGS. 2A and 2B. As shown, a "U" shaped gas discharge tube (Lamp 12) is mounted coaxially within a clear plastic tube, identified as Housing 34, with all the electronics, connection points, and components comprising a Control Unit 14 and Mounting Bracket Interface 36 being mounted in the lower or Base Section 38 of Housing 34. Base Section 38 thereby provides a casing and protection for the Control Unit 14, which may be mounted therein as a self-contained module. It will also be noted that the Control Unit 14 may be directly connected to the Lamp 12, so that the Lamp 12 and Control Unit 14 together comprise a modular unit, or the Lamp 12 may be connected to the Control Unit 14 through a suitable connector or connectors. The Lighting Unit 10 assembly may further include, for example, a Wiring Bushing 40A to seal an opening whereby the power wiring to Control Unit 14 passes through Housing 34 and a Barrier 40B across the interior of Housing 34 below the Control Unit 14 and Lamp 12 to seal the interior of Housing 34 from moisture rising from the base, such as ground moisture.

As indicated, Lighting Unit 10 may further include a Mounting Bracket Interface 42 located in Housing 34 below the Control Unit 14 and Barrier 40B and attached to Housing 34, so that the Lighting Unit 10 may thereby be attached to and supported by a Support 44. Support 44 may be, for example, a stake to be inserted into the ground to support the Lighting Unit 10, or a bracket, or tubular or rod-like member or any structural component of suitable shape that is in turn, and for example, mounted onto or a part of a supporting structure, such as a post, railing, house or walkway.

Figure 3:
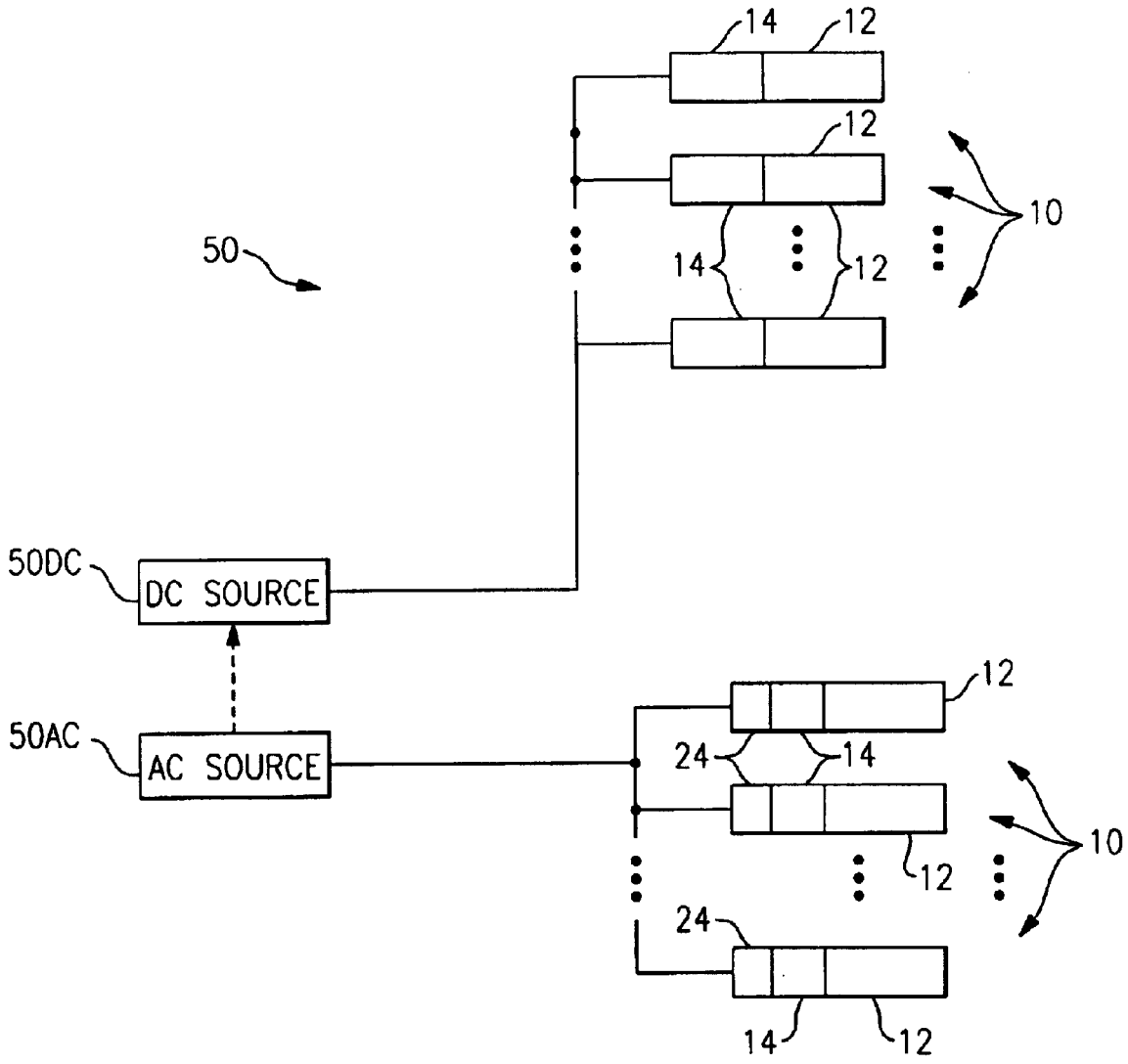
FIG. 3 is a diagram of a lighting system constructed with the lamp unit.

As illustrated, in the exemplary embodiment of FIG. 3 the top curved Apex 12A of the Lamp 12 is supported by a Baffle 46 fitting within Housing 34. Baffle 46 may be comprised, for example, of a circular flexible piece of material that fits securely with in the inner diameter of Housing 34 and that is provided with a slot to nest the Apex 12A of the Lamp 12. It will be noted that in the embodiment illustrated in FIG. 3 there are no visible support mechanisms along the light emitting length of the Lamp 12.

In addition, it will be appreciated that the Base Section 38 of Housing 34, or any other section of Housing 34, may be painted a suitable color or covered by an opaque, transparent or translucent sleeve of any color. In further embodiments, a Top Canopy 48A, perhaps including a decorative Centerpiece 48B, may be is positioned over the top of Housing 34 to direct the emitted light downwards and to shield viewers from the viewing the emitted light directly. Other Canopies 48C, 48D and so on, with clearance to slide over the Housing 34 tube can likewise be positioned and secured at the users discretion, and Canopies 48 may be secured by any suitable fastening, such as an internal slip fitting and set screw. It will also be understood that Canopies 48 may be of a variety of shapes and may be opaque, transparent, translucent, or fabricated with openings to direct the light in any desired direction and for a variety of effects.

It will be appreciated that the above exemplary Lighting Unit 10 may also be embodied in a variety of other forms, some using straight or circular Lamps 12 and concealing the wiring by various means. It will be further appreciated, however, that Lighting Units 10 employing the Control Circuit 14 of the present invention may be embodied and employed in virtually any form, including conventional flourescent lighting fixtures and many conventional incandescent lamp installations.

Lastly, and as illustrated in FIG. 3, a plurality of Lighting Units 10 of a given type or of a plurality of different embodiments maybe incorporated into a Lighting System 50 in virtually any indoor or outdoor lighting system and in replacement for conventional flourescent lighting fixtures or conventional incandescent lamp fixtures. In this regard, it will be understood that DC power may be provided to the Control Units 14 of the individual Lighting Units 10 from a central DC Source 50DC, or that AC power may be provided from an AC Source 50AC to some or all of the individual Lighting Units 10, each of which will thereby include a DC Adaptor 24. Also, a DC Source 50DC may be a direct source of dc power, such as a battery system or unit or a solar power system, or may convert AC power from an AC Source 50AC into dc power, as indicated in FIG. 3.

Since certain changes may be made in the above described invention without departing from the spirit and scope of the invention herein involved, it is intended that all of the subject matter of the above description or shown in the accompanying drawings shall be interpreted merely as examples illustrating the inventive concept herein and shall not be construed as limiting the invention.

What is claimed is:

1. A control circuit for controlling the light emission of a cold cathode gas discharge lamp, comprising:

a dc power source, and a control circuit for converting dc power from the dc power source into a high frequency drive signal across the lamp, wherein each cycle of the drive signal includes an ignition period with a signal level sufficient to initiate gas conduction, a sustaining period with a signal level sufficient to sustain gas conduction, and an off period with a signal level below the sustaining level.

2. A control circuit for generating a high frequency drive signal controlling the light emission of a cold cathode gas discharge lamp, comprising:

a transformer having a primary winding connected from a dc power source and in series with a switching transistor, and a secondary winding connected across the lamp, and a drive signal timing circuit, including a feedback winding of the transformer connected between the base of the switching transistor and a timing control output of a resistor-capacitor ramp generator, wherein each cycle of the drive signal includes an ignition period with a signal level sufficient to initiate gas conduction, a sustaining period with a signal level sufficient to sustain gas conduction, and an off period with a signal level below the sustaining level.

3. The control circuit of claim 2, wherein:

in each cycle of the drive signal, during the off period, the drive signal timing circuit generates a timing control output having a voltage level increasing with time until the timing control output reaches a base-emitter turn on voltage of the transistor, during the ignition period, current flows through the transistor and in the primary winding, the current flow being initiated by the timing control output and sustained by feedback from the primary winding to the feedback winding, until the transformer saturates and the feedback signal to transistor is terminated, driving the transistor into the non-conducting state, and a magnetic field in the transformer collapses, inducing a drive signal in the secondary winding having a signal level sufficient to initiate gas conduction in the lamp, during the sustaining period, continued collapse of the magnetic field induces a drive signal in the secondary winding having a signal level sufficient to sustain gas conduction, and during the off period, the magnetic field has collapsed and the induced drive signal in the secondary winding is at a signal level below the sustaining level.

4. The control circuit of claim 2, wherein:

the dc power source is an ac to dc adaptor connected from an ac power source.

5. The control circuit of claim 2, wherein:

the resistor-capacitor ramp generator of the drive signal timing circuit includes a variable resistor to select the period of the drive signal.

6. A lighting unit, comprising:

a cold cathode gas discharge lamp, and a control circuit for generating a high frequency drive signal controlling the light emission of the cold cathode gas discharge lamp, including a transformer having a primary winding connected from a dc power source and in series with a switching transistor, and a secondary winding connected across the lamp, and a drive signal timing circuit, including a feedback winding of the transformer connected between the base of the switching transistor and a timing control output of a resistor-capacitor ramp generator, wherein each cycle of the drive signal includes an ignition period with a signal level sufficient to initiate gas conduction, a sustaining period with a signal level sufficient to sustain gas conduction, and an off period with a signal level below the sustaining level.

7. A lighting system, comprising:

a plurality of lighting units, each lighting unit including a cold cathode gas discharge lamp, and a control circuit for generating a high frequency drive signal controlling the light emission of the cold cathode gas discharge lamp, including a transformer having a primary winding connected from a dc power source and in series with a switching transistor, and a secondary winding connected across the lamp, and a drive signal timing circuit, including a feedback winding of the transformer connected between the base of the switching transistor and a timing control output of a resistor-capacitor ramp generator, wherein each cycle of the drive signal includes an ignition period with a signal level sufficient to initiate gas conduction, a sustaining period with a signal level sufficient to sustain gas conduction, and an off period with a signal level below the sustaining level.

8. The lighting system of claim 7, wherein:

the dc power source of at least one of the lighting units is a central dc power source.

9. The lighting system of claim 8, wherein:

in at least certain of the lighting units, the dc power source includes a dc adapter located at the lighting unit and providing dc power to the lighting unit, the dc adapter being connected from an ac power source.

10. A lighting unit, comprising:

a tubular lamp housing, a U-shaped cold cathode gas discharge lamp mounted in the housing with all electrodes of the lamp located at a base end of the housing, a control circuit mounted in the base end of the housing for converting dc power from the dc power source into a high frequency drive signal across the lamp, wherein each cycle of the drive signal includes an ignition period with a signal level sufficient to initiate gas conduction, a sustaining period with a signal level sufficient to sustain gas conduction, and an off period with a signal level below the sustaining level.

11. The light unit of claim 10, further comprising:

a mounting bracket for attaching the light unit to a support.

12. The light unit of claim 10, wherein:

the dc power source includes a dc adapter located at the lighting unit and providing dc power to the lighting unit, the dc adapter being connected from an ac power source.

13. The light unit of claim 10, further comprising:

at least one canopy mounted to the tubular housing to direct the emitted light.

* * * * *